US011138924B1

(12) United States Patent
Hashimoto

(10) Patent No.: US 11,138,924 B1
(45) Date of Patent: Oct. 5, 2021

(54) DRIVING CIRCUIT FOR DRIVING A LIGHT EMITTING UNIT

(71) Applicant: Innolux Corporation, Miao-Li County (TW)

(72) Inventor: Kazuyuki Hashimoto, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 0 days.

(21) Appl. No.: 16/920,449

(22) Filed: Jul. 3, 2020

(51) Int. Cl.
*G09G 3/32* (2016.01)

(52) U.S. Cl.
CPC ..... *G09G 3/32* (2013.01); *G09G 2310/0264* (2013.01)

(58) Field of Classification Search
CPC ..... G09G 2310/0264; G09G 3/32
See application file for complete search history.

(56) References Cited

U.S. PATENT DOCUMENTS

| | | | | |
|---|---|---|---|---|
| 7,973,748 | B2 * | 7/2011 | Chiou | G09G 3/3283 345/82 |
| 10,629,133 | B2 * | 4/2020 | Kim | G09G 3/3266 |
| 2014/0160093 | A1 * | 6/2014 | Chaji | G09G 3/3258 345/204 |
| 2014/0347401 | A1 * | 11/2014 | Hwang | G09G 3/3233 345/690 |
| 2017/0249904 | A1 * | 8/2017 | Li | G09G 3/3233 |

* cited by examiner

*Primary Examiner* — Muhammad N Edun
(74) *Attorney, Agent, or Firm* — JCIPRNET

(57) ABSTRACT

A driving circuit for driving a light emitting unit includes a driving transistor, a compensating transistor, and a switch transistor is provided. The driving transistor includes a gate terminal, a source terminal, and a drain terminal. The compensating transistor includes a gate terminal electrically connected to the gate terminal of the driving transistor, a source terminal, and a drain terminal electrically connected to the gate terminal of the driving transistor. The switch transistor includes a gate terminal, a source terminal, and a drain terminal electrically connected to the source terminal of the compensating transistor.

19 Claims, 13 Drawing Sheets

DRIVING CIRCUIT FOR DRIVING A LIGHT EMITTING UNIT

BACKGROUND

Technical Field

The disclosure is related to a driving circuit for driving a light emitting unit.

Description of Related Art

Light emitting devices have been widely applied in various fields, for displaying, illuminating, etc. A driving circuit for driving a light emitting unit affects the operation of the light emitting devices and thus plays an important role in designing the light emitting devices.

SUMMARY

The disclosure is directed to a driving circuit for driving a light emitting unit with an improved light emitting quality.

According to an embodiment, a driving circuit for driving a light emitting unit includes a driving transistor, a compensating transistor, and a switch transistor. The driving transistor includes a gate terminal, a source terminal, and a drain terminal. The compensating transistor includes a gate terminal electrically connected to the gate terminal of the driving transistor, a source terminal, and a drain terminal electrically connected to the gate terminal of the driving transistor. The switch transistor includes a gate terminal, a source terminal, and a drain terminal electrically connected to the source terminal of the compensating transistor.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Certain terms are used throughout the description and following claims to refer to particular components. As one skilled in the art will understand, electronic equipment manufacturers may refer to a component by different names. This document does not intend to distinguish between components that differ in name but not function. In the following description and in the claims, the terms "include", "comprise" and "have" are used in an open-ended fashion, and thus should be interpreted to mean "include, but not limited to . . . ". Thus, when the terms "include", "comprise" and/or "have" are used in the description of a disclosure, the corresponding features, areas, steps, operations and/or components would be pointed to existence, but not limited to the existence of one or a plurality of the corresponding features, areas, steps, operations and/or components.

Electrical connection as described in the disclosure may refer to direct connection or indirect connection. In the case of direct connection, the terminal points of two components on the circuit are directly connected or are connected to each other via a conductor line segment. In the case of indirect connection, a switch, a diode, a capacitor, an inductor, a resistor, another suitable component, or a combination of the above components is present between the terminal points of two components on the circuit. However, the disclosure is not limited thereto.

Although terms such as first, second, third, etc., may be used to describe diverse constituent elements, such constituent elements are not limited by the terms. The terms are used only to discriminate a constituent element from other constituent elements in the specification. The claims may not use the same terms, but instead may use the terms first, second, third, etc. with respect to the order in which an element is claimed. Accordingly, in the following description, a first constituent element may be a second constituent element in a claim.

In a disclosure, adjacent circuit units may share the same parts or wires and may also include its specific parts therein. In addition, any value disclosed herein may imply a certain range around the disclosed value; for example, if a first value is equal to a second value, it is implied that there may be an error of about 10% between the first value and the second value.

It should be noted that the technical features in different embodiments described in the following can be replaced, recombined, or mixed with one another to constitute another embodiment without departing from the spirit of a disclosure.

Figure 1:
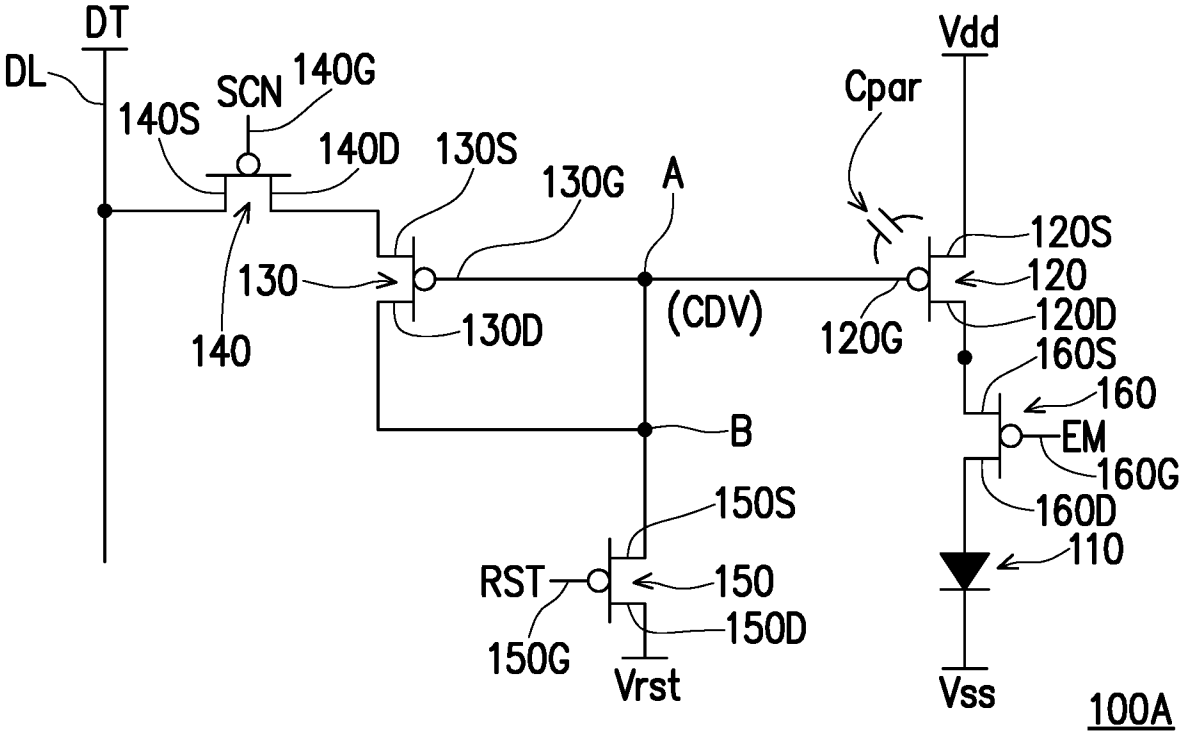
FIG. 1 schematically illustrates a driving circuit for driving a light emitting unit in accordance with some embodiments of the disclosure.

FIG. 1 schematically illustrates a driving circuit for driving a light emitting unit in accordance with some embodiments of the disclosure. A driving circuit 100A for driving a light emitting unit 110 may include at least a driving transistor 120, a compensating transistor 130, and a switch transistor 140. The driving transistor 120 includes a gate terminal 120G, a source terminal 120S, and a drain terminal 120D. The compensating transistor 130 includes a gate terminal 130G electrically connected to the gate terminal 120G of the driving transistor 120, a source terminal 130S, and a drain terminal 130D electrically connected to the gate terminal 120G of the driving transistor 120. The switch transistor 140 includes a gate terminal 140G electrically connected to a scan signal SCN, a source terminal 140S, and a drain terminal 140D electrically connected to the source terminal 130S of the compensating transistor 130. The driving circuit 100A may further include a data line DL, and the source terminal 140S of the switch transistor 140 is electrically connected to the data line DL. In addition, the source terminal 120S of the driving transistor 120 may be electrically connected to a driving voltage Vdd. In the embodiment, the light emitting unit 110 may emit light via a driving current, and the drain terminal 120D of the driving transistor 120 may be electrically connected to the light emitting unit 110 to control the driving current. Specifically, the light emitting unit 110 may be a current-driven component such as a light emitting diode, the light emitting diode (LED) may include an inorganic light emitting diode, an organic light emitting diode (OLED), a mini light emitting diode (mini-LED), a micro light emitting diode (micro-LED), or a quantum dot light emitting diode (QLED or QDLED), but the disclosure is not limited thereto.

In the driving circuit 100A, the switch transistor 140 may be turned on or turned off according to a scan signal SCN to the gate terminal 140G of the switch transistor 140 and the on-off operation of the switch transistor 140 may determine whether a data voltage DT on the data line DL is transmitted to the compensating transistor 130. In other words, the data voltage DT on the data line DL is transmitted through the source terminal 140S of the switch transistor 140 and the drain terminal 140D of the switch transistor 140 to the source terminal 130S of the compensating transistor 130. The drain terminal 130D of the compensating transistor 130 and the gate terminal 130G of the compensating transistor 130 are both electrically connected to the gate terminal 120G of the driving transistor 120 at a node A, and the node A in FIG. 1 represents the node that the gate terminal 120G, the gate terminal 130G and the drain terminal 130D are electrically connected. In the embodiment, the compensating transistor 130 has a diode connection configuration since the gate terminal 130G is electrically connected to the drain terminal 130D. Due to the diode connection configuration of the compensating transistor 130, the data voltage DT on the source terminal 130S may be transmitted to the node A with the compensation of the compensating transistor 130 so that a compensated data voltage CDV is provided to the node A. In some embodiments, the compensated data voltage CDV may be a result of the voltage value of the data voltage DT subtracting the absolute value of the threshold voltage of the compensating transistor 130. In addition, the driving transistor 120 and the compensating transistor 130 may have substantially the same threshold voltage. The compensated data voltage CDV may enable the driving transistor 120 to be turned on so that the driving voltage Vdd is allowed to be provided to the drain terminal 120D of the driving transistor 120.

The driving circuit 100A may further include a reset transistor 150 and a first emission transistor 160. The reset transistor 150 is electrically connected to the gate terminal 120G of the driving transistor 120, and the first emission transistor 160 is electrically connected between the drain terminal 120D of the driving transistor 120 and the light emitting unit 110. The reset transistor 150 may include a gate terminal 150G electrically connected to a reset signal RST, a source terminal 150S electrically connected to the gate terminal 120G of the driving transistor 120 at a node B, and a drain terminal 150D electrically connects to a reset voltage Vrst. In FIG. 1, the node B represents the node that the source terminal 150S of the reset transistor 150 electrically connected to the electrical connection path through which the gate terminal 120G, the gate terminal 130G and the drain terminal 130D are electrically connected. In some embodiments, the node A and the node B may be combined. In some alternative embodiments, the source terminal 150S of the reset transistor 150 may be electrically connected to the gate terminal 120G of the driving transistor 120 though another node, and the disclosure is not limited thereto. The first emission transistor 160 may include a gate terminal 160G electrically connected to an emission signal EM, a source terminal 160S electrically connected to the drain terminal 120D of the driving transistor 120 and a drain terminal 160D electrically connected to the light emitting unit 110.

In the present embodiment, the driving transistor 120 may be a larger size transistor while the compensating transistor 130 may have a smaller size. In some embodiments, the size of the driving transistor 120 may be 1 to 50 times larger than the size of the compensating transistor 130, but the disclosure is not limited thereto. The coupling effect between terminals in the driving transistor 120 may be more significant than that in the compensating transistor 130 due to the difference in size. In some embodiments, a parasitic capacitor Cpar may be formed between the gate terminal 120G of the driving transistor 120 and the source terminal 120S of the driving transistor 120 and have influence on the operation of the driving circuit 100A. For example, the compensated data voltage CDV provided to the node A may be maintained in a certain range by the parasitic capacitor Cpar and may have less reduction from the compensating transistor 130, so that the driving transistor 120 may have a stable light emission with less undesirable fluctuation.

In the embodiment, the driving circuit 100A includes five transistors, i.e. the driving transistor 120, the compensating transistor 130, the switch transistor 140, the reset transistor 150, and the first emission transistor 160, and the five transistors may be of the same conductive type transistors. For example, the five transistors may all be p-type transistors, and the turn-on voltage may be a logic low voltage while the turn-off voltage may be a logic high voltage. However, the disclosure is not limited thereto. The operation of the driving circuit 100A may include a reset stage, a scan stage, and an emission stage respectively shown in FIG. 2, FIG. 3 and FIG. 4 and the five transistors are p-type transistors, but the disclosure is not limited thereto. In some embodiments, the five transistors are all n-type transistors, in some other embodiments, some transistors may be n-type transistors, and some transistors may be p-type transistors.

Figure 2:
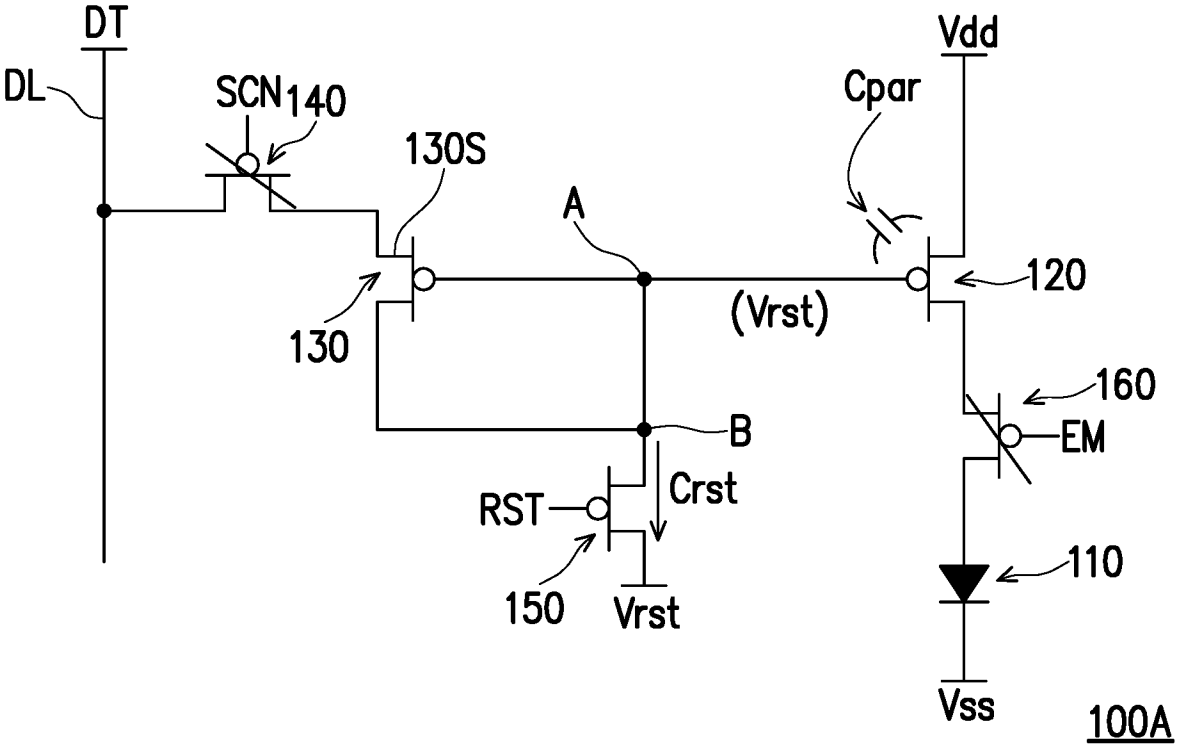
FIG. 2 shows the driving circuit in a reset stage in accordance with some embodiments of the disclosure.

In FIG. 2, which shows the driving circuit 100A in the reset stage, the reset transistor 150 is turned on while the switch transistor 140 and the first emission transistor 160 is turned off. Upon the turning on of the reset transistor 150, a reset voltage Vrst is supplied to the node B and node A with a reset current Crst through the reset transistor 150. In the embodiment, the reset voltage Vrst may be sufficient to turn on the driving transistor 120 and the compensating transistor 130, and may be stored by the parasitic capacitor Cpar. Namely, once the reset transistor 150 is turned off, the driving transistor 120 and the compensating transistor 130 remain on due to the reset voltage Vrst provided on the node A and the node B.

Figure 3:
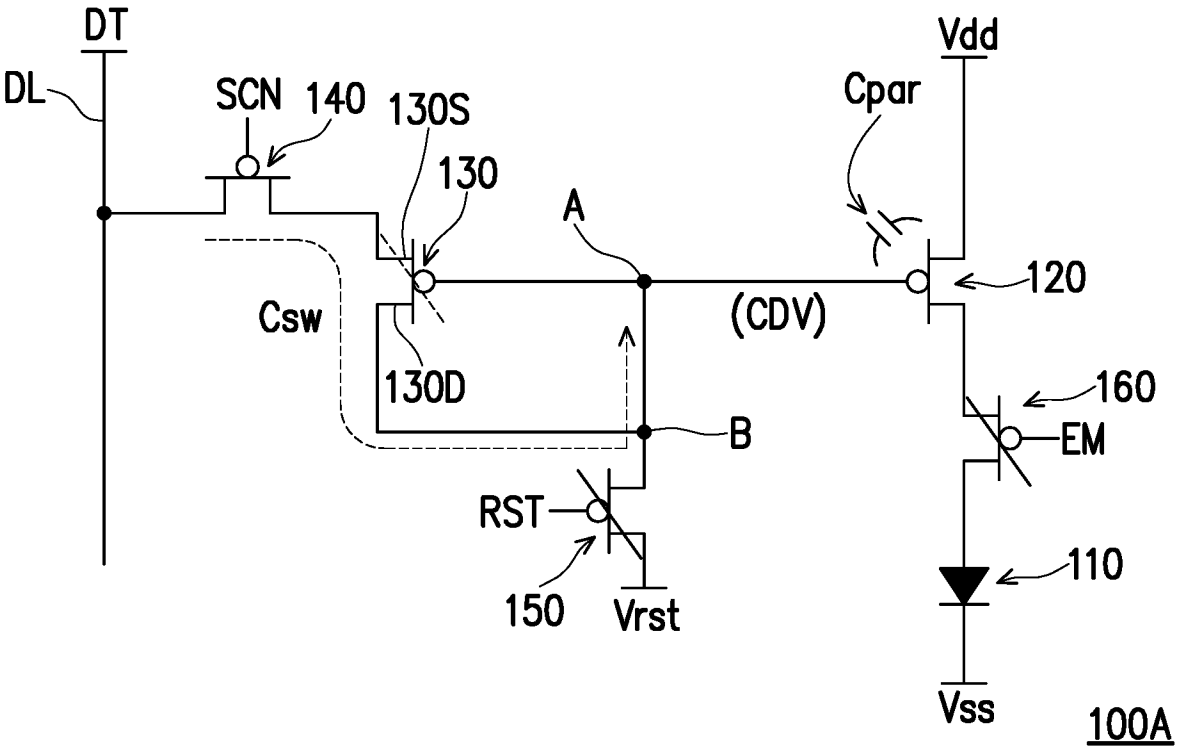
FIG. 3 shows the driving circuit in a scan stage in accordance with some embodiments of the disclosure.

In FIG. 3, which shows the driving circuit 100A in the scan stage following the reset stage, the reset transistor 150 is turned off and the switch transistor 140 is turned on while the first emission transistor 160 remains off. Upon the turning on of the switch transistor 140, the data voltage DT on the data line DL is allowed to be transmitted to the source terminal 130S of the compensating transistor 130 through the switch transistor 140, and the compensating transistor 130 further allows the electrical connection between the source terminal 130S of the compensating transistor 130 and the drain terminal 130D of the compensating transistor 130, such that a switch current Csw is generated and flows from the data line DL, through the switch transistor 140 and the compensating transistor 130 to the node B as well as the node A. Due to the diode connection configuration of the compensating transistor 130, the data voltage DT on the data line DL may be compensated so that the compensated data voltage CDV may be supplied to and stored at the node A with the effect of the parasitic capacitor Cpar in the driving transistor 120. In some embodiments, the compensated data voltage CDV may be a result of the voltage value of the data voltage DT subtracting the absolute value of the threshold voltage of the compensating transistor 130 and enable the driving transistor 120 to be turned on. In addition, the compensating transistor 130 may become turned off state after the compensated data voltage CDV is stored at the node A. In other words, the switch current Csw may disappear upon the compensated data voltage CDV is supplied to and stored at the node A. The voltage value of the compensated data voltage CDV may exceed the threshold gate-source voltage (the gate-source voltage is known as the voltage difference across the gate terminal and source terminal of a transistor), of the driving transistor 120 and enables the driving transistor 120 to be turned on.

Figure 4:
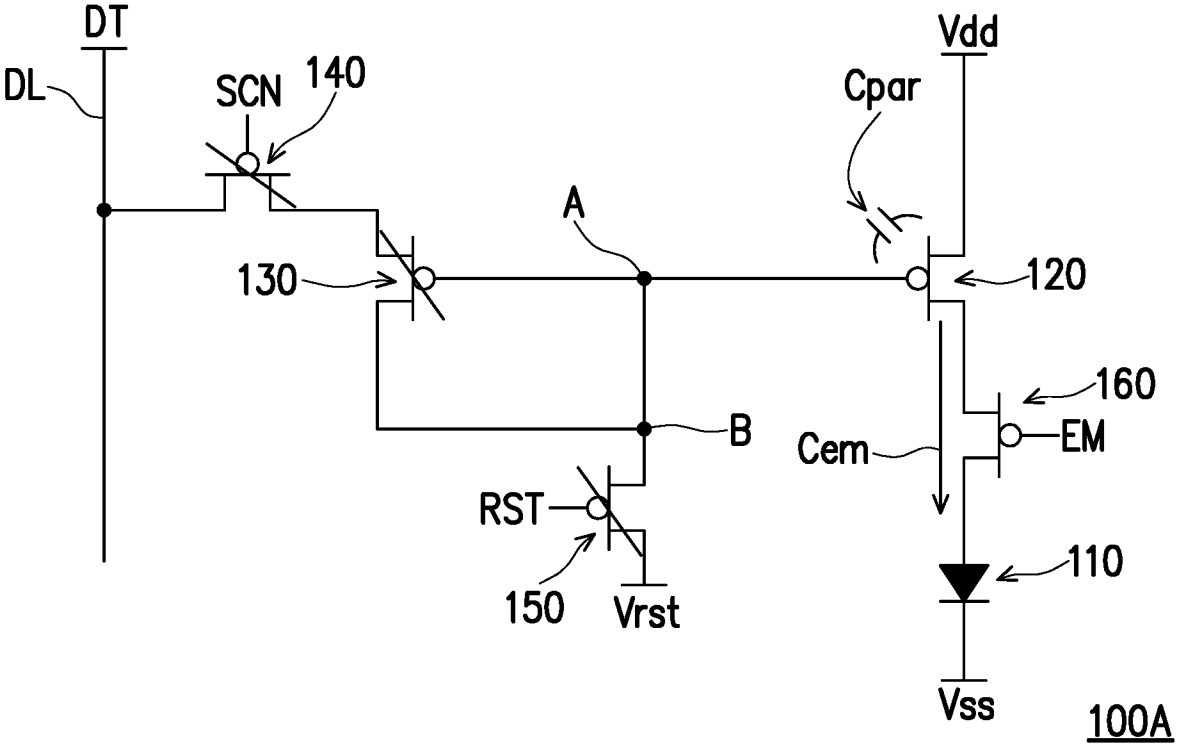
FIG. 4 shows the driving circuit in an emission stage in accordance with some embodiments of the disclosure.

In FIG. 4, which shows the driving circuit 100A in the emission stage following the scan stage, the switch transistor 140 may be turned off and the first emission transistor 160 may be turned on while the reset transistor 150 remains off. In the emission stage, the driving transistor 120 remains on since the parasitic capacitor Cpar stores the compensated data voltage CDV at the node A (i.e., the gate terminal of the driving transistor 120). Namely, the gate-source voltage of the driving transistor 120 is kept in a certain range by the parasitic capacitor Cpar. As such, the driving voltage Vdd is allowed to be transmitted to one terminal of the light emitting unit 110 while the other terminal of the light emitting unit 110 is electrically connected to another driving voltage Vss. In some embodiments, the driving voltage Vdd may be a high level voltage and the driving voltage Vss may be a low level voltage, such that an emission current Cem may be generated and pass through the light emitting unit 110 to enable the light emitting unit 110 to emit light, but the disclosure is not limited thereto.

Figure 5:
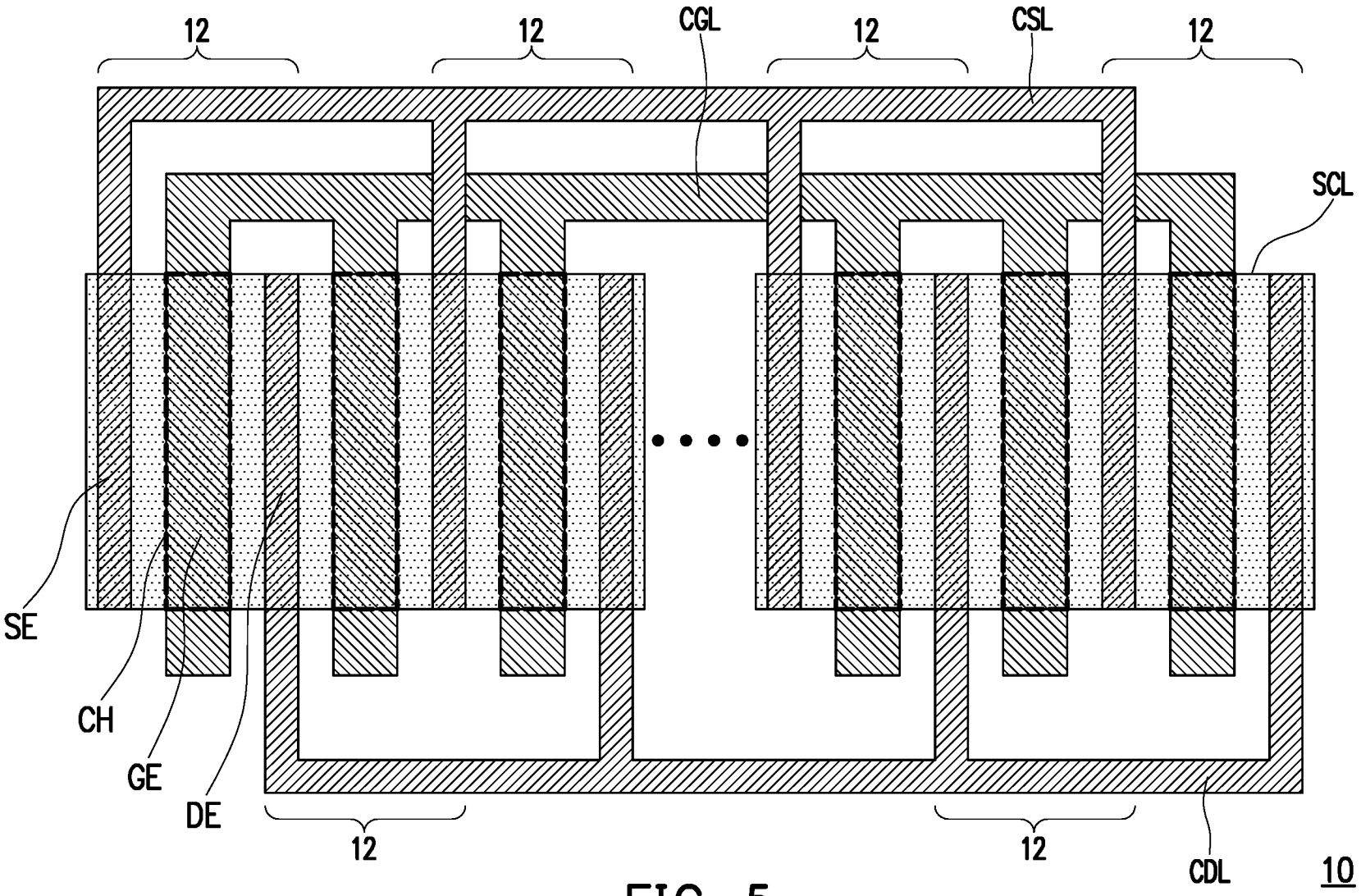
FIG. 5 schematically illustrates a top view of a layout of a transistor in accordance with some embodiments.

FIG. 5 schematically illustrates a top view of a layout of a transistor in accordance with some embodiments. In FIG. 5, a transistor 10 may include a plurality of sub-transistors 12 electrically connected in parallel and the transistor 10 may be served as an implemental layout of one or more of the transistors in the driving circuit 100A and any embodiments described in the disclosure. The transistor 10 includes a semiconductor layer SCL which is made of a semiconductor material such as crystalline silicon, poly-crystalline silicon, amorphous silicon, oxide semiconductor material, or organic semiconductor material, but the disclosure is not limited thereto. In some embodiments, different transistors may comprise the semiconductor layer made of different semiconductor materials, but the disclosure is not limited thereto. Each of the sub-transistors 12 includes a gate electrode GE, a source electrode SE and a drain electrode DE to overlap the semiconductor layer SCL, and the gate electrode GE is positioned between the source electrode SE and the drain electrode DE in a top view. The gate electrodes GE of the sub-transistors 12 may be connected to a common gate line CGL, the source electrodes SE of the sub-transistors 12 may be connected to a common source line CSL and the drain electrodes DE of the sub-transistors 12 may be connected to a common drain line CDL, so that the sub-transistors 12 are connected in parallel. In addition, adjacent sub-transistors 12 may share the source electrode SE and/or the drain electrode DE so that the layout area of the transistor 10 may be compact.

Figure 6:
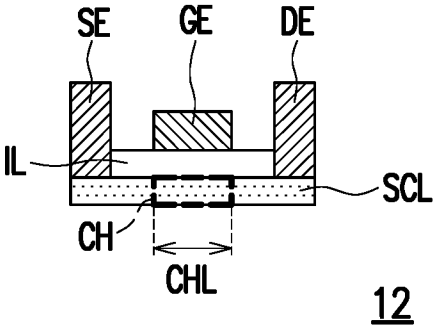
FIG. 6 schematically illustrates a top view of the layout of a single sub-transistor.

FIG. 6 schematically illustrates a cross section of a sub-transistor in accordance with some embodiments. As shown in FIG. 6, in the sub-transistor 12, the gate electrode GE may be disposed over the semiconductor layer SCL with an insulation layer IL therebetween, such that the gate electrode GE may not directly contact the semiconductor layer SCL. The source electrode SE and the drain electrode DE are disposed on the semiconductor layer SCL and directly contact the semiconductor layer SCL. The region that a gate electrode GE overlaps the semiconductor layer SCL may be considered as a channel region CH, and the source electrode SE and the drain electrode DE are located at two opposite sides of the channel region CH. The characteristic of the transistor 10 may be determined by the channel regions CH of the sub-transistors 12.

Figure 7:
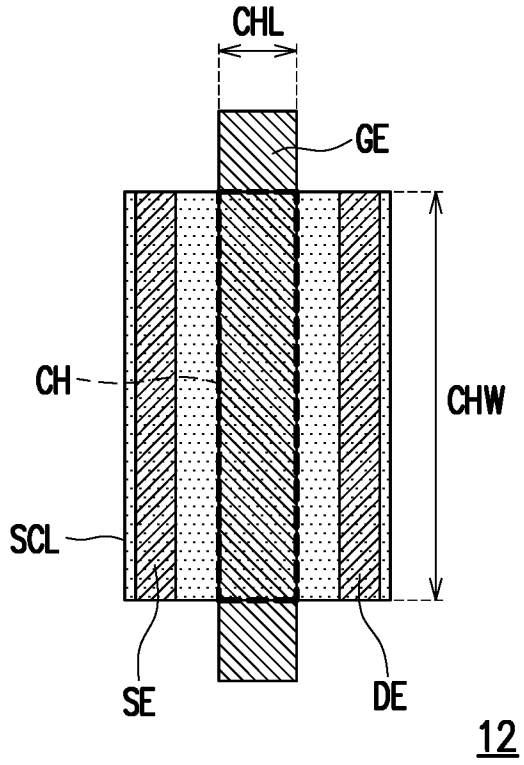
FIG. 7 schematically illustrates a cross section of a sub-transistor in accordance with some embodiments.

FIG. 7 schematically illustrates a top view of the layout of a single sub-transistor 12. Referring to FIG. 5 to FIG. 7, the channel region CH of each sub-transistor 12 may have a sub-channel length CHL measured in a direction across the gate electrode GE from the source electrode SE to the drain electrode DE, and a sub-channel width CHW measured in a direction intersecting the direction for measuring the sub-channel length CHL. In the disclosure, the ratio of the sub-channel width CHW to the sub-channel length CHL of the sub-transistor 12 (i.e., CHW/CHL) may represent the size of the sub-transistor 12, and the size of the transistor 10 may be known as the sum of the sizes of the sub-transistors 12 of the transistor 10.

In some embodiments, to achieve the design in the previous embodiment that the driving transistor 120 is larger than the compensating transistor 130 in size, the driving transistor 120 may have the structure similar to the transistor 10 and the compensating transistor 130 may have the structure similar to one sub-transistor 12. For example, the compensating transistor 130 may be constructed by one sub-transistor 12 and the driving transistor 120 may be constructed by multiple sub-transistors 12 connected in parallel. The size of the sub-transistors 12 for constructing the driving transistor 120 may be substantially identical to the size of the sub-transistor 12 for constructing the compensating transistor 130, such that the threshold voltage of the compensating transistor 130 and the threshold voltage of the driving transistor 120 may be substantially identical. In some embodiments, the compensating transistor 130 may be positioned beside and close to the driving transistor 120 in the layout design of the driving circuit 100A. In some embodiments, the driving transistor 120 and the compensating transistor 130 may be as close as possible in the applied device to have an improved uniformity. It should be noted that the shapes of the driving transistor 120 and the compensating transistor 130 shown in FIG. 5 to FIG. 7 are only exemplary, the disclosure is not limited thereto.

Figure 8:
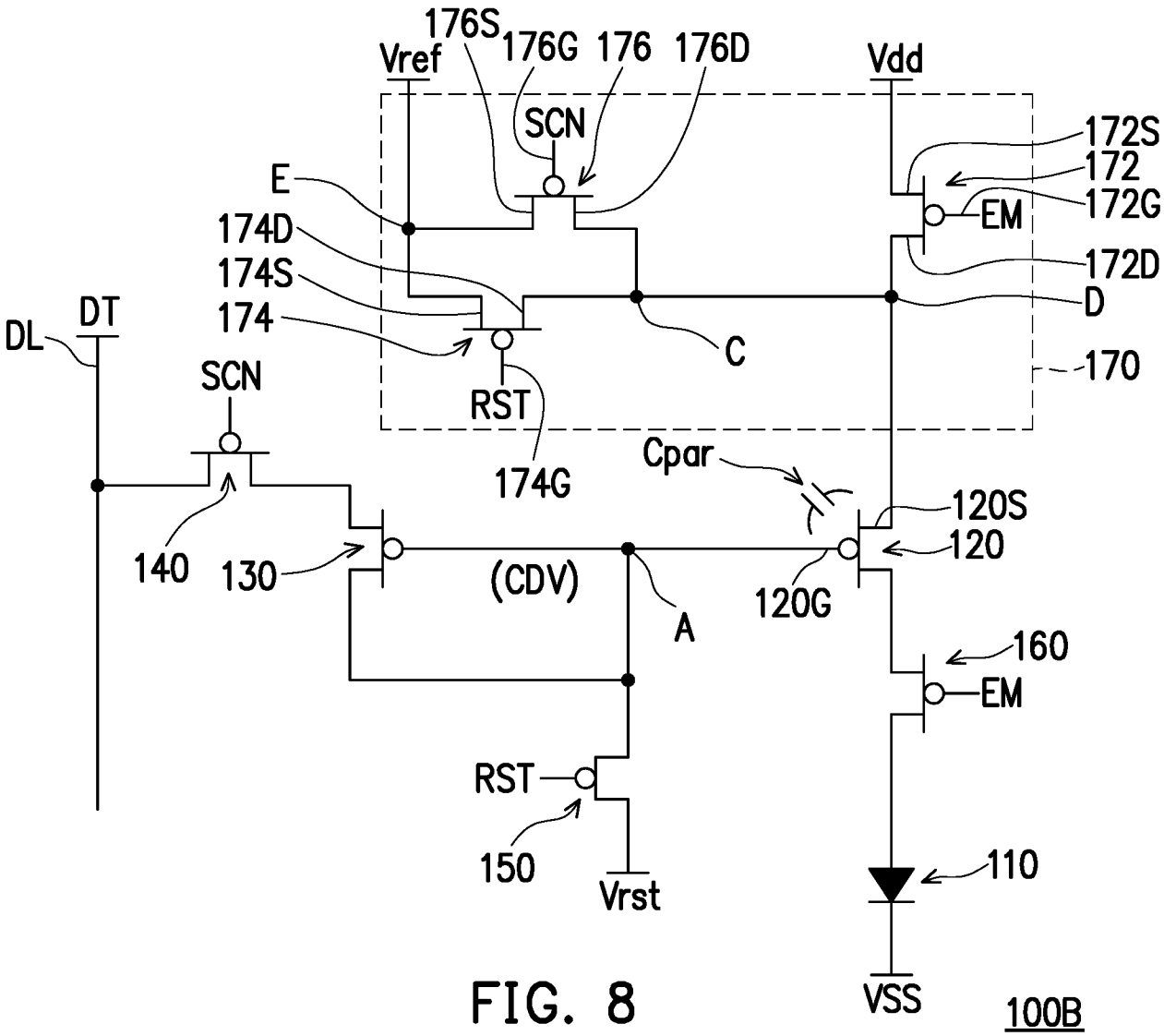
FIG. 8 schematically illustrates a driving circuit for driving a light emitting unit in accordance with some embodiments.

FIG. 8 schematically illustrates a driving circuit for driving a light emitting unit in accordance with some embodiments. In FIG. 8, a driving circuit 100B for driving a light emitting unit 110, similar to the driving circuit 100A shown in FIG. 1, includes a driving transistor 120, a compensating transistor 130, a switch transistor 140, a reset transistor 150, and a first emission transistor 160, and the difference is that the driving circuit 100B further includes a selection unit 170. Herein, the electrical connection of the light emitting unit 110, the driving transistor 120, the compensating transistor 130, the switch transistor 140, the reset transistor 150, and the first emission transistor 160 may refer to the previous description and is not reiterated. The selection unit 170 may be electrically connected to the source terminal 120S of the driving transistor 120 and configured to select one of a driving voltage Vdd and a reference voltage Vref to be electrically connected to the source terminal 120S of the driving transistor 120.

In the embodiment, the selection unit 170 may include a selection emission transistor 172, a selection reset transistor 174 and a selection switch transistor 176. The selection emission transistor 172 may include a gate terminal 172G electrically connected to the emission signal EM, a source terminal 172S electrically connected to the driving voltage Vdd, and a drain terminal 172D electrically connected to the source terminal 120S of the driving transistor 120. The selection reset transistor 174 may include a gate terminal 174G electrically connected to the reset signal RST, a source terminal 174S electrically connected to the reference voltage Vref, and a drain terminal 174D electrically connected to the drain terminal 172D of the selection emission transistor 172. The selection switch transistor 176 may include a gate terminal 176G electrically connected to the scan signal SCN a source terminal 176S electrically connected to the reference voltage Vref, and a drain terminal 176D electrically connected to the drain terminal 174D of the selection reset transistor 174. Specifically, the drain terminal 174D of the selection reset transistor 174 and the drain terminal 176D of the selection switch transistor 176 may be electrically connected to each other at a node C that is electrically connected to the drain terminal 172D of the selection emission transistor 172 at a node D. The drain terminal 172D of the selection emission transistor 172 is electrically connected to the source terminal 120S of the driving transistor 120. Therefore, the node C and the node D represent that the drain terminal 172D of the selection emission transistor 172, the drain terminal 174D of the selection reset transistor 174, and the drain terminal 176D of the selection switch transistor 176 are electrically connected to the source terminal 120S of the driving transistor 120. In some embodiment, the node C and the node D may be combined, but the disclosure is not limited thereto. In addition, the source terminal 174S of the selection reset transistor 174 may be electrically connected to the source terminal 176S of the selection switch terminal 176 at a node E and the node E may be electrically connected to the reference voltage Vref.

The operation of the driving circuit 100B may include a reset stage, a scan stage and an emission stage. In the reset stage, the reset transistor 150 is turned on while the switch transistor 140 and the first emission transistor 160 may be turned off, in the selection unit 170, the selection reset transistor 174 is turned on while the selection emission transistor 172 and the selection switch transistor 176 are turned off. As such, the reset voltage Vrst is provided to the node A through the reset transistor 150 and the reference voltage Vref is provided to the node C as well as the node D through the selection reset transistor 174. Therefore, the source terminal 120S of the driving transistor 120 is supplied by the reference voltage Vref and the gate terminal 120G of the driving transistor 120 is supplied by the reset voltage Vrst.

In the scan stage, the reset transistor 150 is turned off and the switch transistor 140 is turned on while the first emission transistor 160 remains off, and in the selection unit 170, the selection reset transistor 174 is turned off and the selection switch transistor 176 is turned on while the selection emission transistor 172 remains off. During the scan stage, as previously described, the data voltage DT on the data line DL is allowed to be transmitted to the source terminal of the compensating transistor 130 and a compensated data voltage CDV may be supplied to the node A through the diode connection configuration of the compensating transistor 130. In addition, the operation of the selection unit 170 allows the reference voltage Vref to be supplied to the source terminal 120S of the driving transistor 120. Accordingly, the voltage on the source terminal 120S of the driving transistor 120 remains the reference voltage Vref during the reset stage and the scan stage. The compensated driving voltage CDV may be kept at the node A with less influence caused by the fluctuation of the voltage on the source terminal 120S of the driving transistor 120 by the parasitic capacitance Cpar with the reference voltage Vref instead of the driving voltage Vdd.

In the emission stage, the switch transistor 140 may be turned off and the first emission transistor 160 may be turned on while the reset transistor 150 remains off, and the selection switch transistor 176 is turned off and the selection emission transistor 172 is turned on while the selection reset transistor 174 remains off. And the driving voltage Vdd is allowed to be supplied to the source terminal 120S of the driving transistor 120 through turning on of the selection emission transistor 172. The voltage on the source terminal 120S of the driving transistor 120 changes from the reference voltage Vref to the driving voltage Vdd at the time of starting the emission stage. The change of the voltage on the driving transistor 120 may cause the gate-source voltage shift, due to the parasitic capacitor Cpar, the gate-source voltage of the driving transistor 120 is kept in a certain range. Accordingly, during the emission stage, the on state of the driving transistor 120 is stable and the emission current passing through the light emitting unit 110 may be stable with less influenced by the voltage shifting on the source terminal 120S of the driving transistor 120 because the gate-source voltage of the driving transistor 120 is kept by a capacitive coupling with the parasitic capacitance Cpar.

In some embodiments, the reference voltage Vref may be of the same voltage value as the driving voltage Vdd substantially. For example, the reference voltage Vref and the driving voltage Vdd may be set to the same voltage value but may be transmitted in independent transmission paths. The reference voltage Vref is provided during the reset stage and the scan stage rather than the emission stage, and the transmission path of the reference voltage Vref does not pass through the light emitting unit 110 which is a relative high resistance component in the driving circuit 100B. Accordingly, the reference voltage Vref may not subject to an IR drop; namely, the voltage value fluctuation of the reference voltage Vref may be minor or negligible because of a relative small current expected by the high resistance component. Accordingly, the voltage value of the reference voltage Vref provided to the node D as well as the source terminal 120S of the driving transistor 120 may be substantially the same as the predetermined value, which helps to ensure the gate-source voltage of the driving transistor 120 can be kept during the reset stage and the scan stage. The selection unit 170 shown in FIG. 8 is an example, but the disclosure is not limited thereto. In some alternative embodiments, the selection unit 170 may include more transistors or less transistors and may further include other circuit components or an alternative circuit design capable of selecting one of the driving voltage Vdd and the reference voltage Vref to be electrically connected to the source terminal 120S of the driving transistor 120 is applicable in the driving circuit 100B and is included in the scope of the disclosure.

Figure 9:
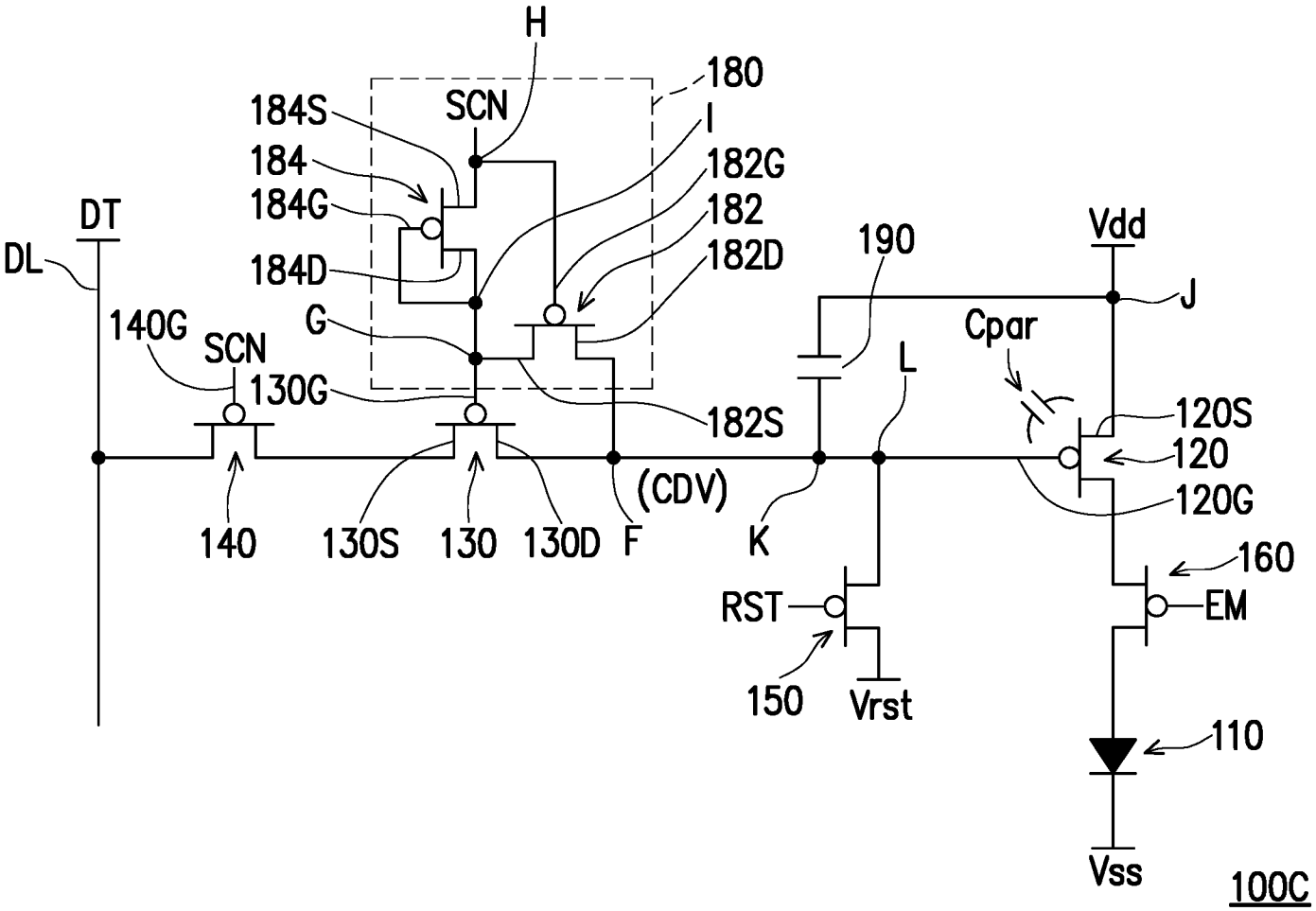
FIG. 9 schematically illustrates a driving circuit for driving a light emitting unit in accordance with some embodiments.

FIG. 9 schematically illustrates a driving circuit for driving a light emitting unit in accordance with some embodiments. In FIG. 9, a driving circuit 100C for driving a light emitting unit 110, similar to the driving circuit 100A shown in FIG. 1, includes a driving transistor 120, a compensating transistor 130, a switch transistor 140, a reset transistor 150, and a first emission transistor 160, and the difference is that the driving circuit further includes a control unit 180 and a storage capacitor 190. Herein, the electrical connection of the light emitting unit 110, the driving transistor 120, the compensating transistor 130, the switch transistor 140, the reset transistor 150, and the first emission transistor 160 may refer to the previous description and is not reiterated. The control unit 180 may include a first control transistor 182 and a second control transistor 184. The first control transistor 182 includes a drain terminal 182D electrically connected to the drain terminal 130D of the compensating transistor 130 at a node F, a source terminal 182S electrically connected to the gate terminal 130G of the compensating transistor 130 at a node G, and a gate terminal 182G. The second control transistor 184 includes a drain terminal 184D electrically connected to the source terminal 182S of the first control transistor 182 at the node G, a source terminal 184S electrically connected to the gate terminal 182G of the first control transistor 182 at a node H, and a gate terminal 184G electrically connected to the drain terminal 184D of the second control transistor 184 at a node I. The storage capacitor 190 is electrically connected between the source terminal 120S of the driving transistor 120 and the gate terminal 120G of the driving transistor 120 at a node J and a node K, respectively. In the embodiment, the gate terminal 182G of the first control transistor 182 and the source terminal 184S of the second control transistor 184 may be electrically connected to the scan signal SCN as the gate terminal 140G of the switch transistor 140, and thus the gate terminal 182G of the first control transistor 182 and the source terminal 184S of the second control transistor 184 may be electrically connected to the gate terminal 140G of the switch transistor 140.

As shown in FIG. 9, the control unit 180 is electrically connected between the gate terminal 130G of the compensating transistor 130 and the drain terminal 130D of the compensating transistor 130. The control unit 180 may be configured to control the operation of the compensating transistor 130. For example, the first control transistor 182 may determine whether gate terminal 130G of the compensating transistor 130 is electrically connected to the drain terminal 130D of the compensating transistor 130, which enables the diode connection of the compensating transistor 130. In addition, in the control unit 180, the gate terminal 184G of the second control transistor 184 may be electrically connected to the drain terminal 184D of the second control transistor 184, such that the second control transistor 184 may have a diode connection configuration which may help to ensure the off state of the compensating transistor 130.

The operation of the driving circuit 100C, similar to the previous embodiments, may include a reset stage, a scan stage, and an emission stage. In the reset stage, the reset transistor 150 electrically connected to the gate terminal 120G of the driving transistor 120 may be turned on to transmit a reset voltage Vrst to a node L while the switch transistor 140, the first emission transistor 160, and the first control transistor 180 are turned off. In the embodiment, the node L is electrically connected to the node F and the node K, such that the reset voltage Vrst may also be transmitted to the drain terminal 130D of the compensating transistor 130 and the gate terminal 120G of the driving transistor 120. In addition, the reset voltage Vrst may be stored at the nodes F, K, and L by the storage capacitor 190 and the parasitic capacitor Cpar formed between the gate terminal 120G of the driving transistor 120 and the source terminal 120S of the driving transistor 120.

In the scan stage, the reset transistor 150 is turned off and the switch transistor 140 is turned on while the first emission transistor 160 remains off. The first control transistor 182 is turned on by the same scan signal as the switch transistor 140. A data voltage DT on a data line DL is allowed to be transmitted to the source terminal 130S of the compensating transistor 130 through the switch transistor 140. The turned-on first control transistor 182 allows the electrical connection of the gate terminal 130G of the compensating transistor 130 and the drain terminal 130D of the compensating transistor 130, which enables the diode connection of the compensating transistor 130. Accordingly, similar to the embodiments described above, a compensated data voltage may be supplied to the drain terminal 130D of the compensating transistor 130 as well as the node F, the node K, the node L and the gate terminal 120G of the driving transistor 120. The compensated data voltage CDV may be a result of the voltage value of the data voltage DT subtracting the absolute value of the threshold voltage of the compensating transistor 130 and enable the driving transistor 120 to be turned on. The compensated data voltage is stored on the drain terminal 130D of the compensating transistor 130 as well as the node F, the node K, the node L and the gate terminal 120G of the driving transistor 120 by the storage capacitor 190 as well as the parasitic capacitor Cpar between the source terminal 120S of the driving transistor 120 and the gate terminal 120G of the driving transistor 120. In addition, during the scan stage, the node G and the node I may also be supplied by the compensated data voltage.

In the emission stage, the switch transistor 140 and the first control transistor 182 are turned off, and the first emission transistor 160 is turned on while the reset transistor 150 remains off. In addition, the driving transistor 120 remains on due to compensated data voltage stored by the storage capacitor 190 and the parasitic capacitor Cpar. Specifically, the storage capacitor 190 and the parasitic capacitor Cpar may keep the gate-source voltage of the driving transistor 120 that is written in the scan stage and thus the driving voltage Vdd is allowed to be transmitted to one terminal of the light emitting unit 110 through the driving transistor 120 and the first emission transistor 160 while the other terminal of the light emitting unit 110 is electrically connected to another driving voltage Vss, which enables the light emitting unit 110 to emit light.

In the emission stage, the control unit 180 may help to maintain the compensated data voltage stored at the gate terminal 120G of the driving transistor 120 with less leakage. Specifically, the second control transistor 184 in the control unit 180 has the diode connection configuration which allows one way current direction from the source terminal 184S to the drain terminal 184D to turn off the compensation transistor 130 intentionally with biasing the gate terminal of the compensation transistor 130. Therefore, there is almost no leakage current from the parasitic capacitor Cpar and/or the storage capacitor 190 to the data line DL. In some embodiments, the storage capacitor 190 in the driving circuit 100C may be omitted and the voltage maintenance may be achieved by the parasitic capacitor Cpar. In some alternative embodiments, the storage capacitor 190 may be applicable in the driving circuit 100A, or the driving circuit 100B.

Figure 10:
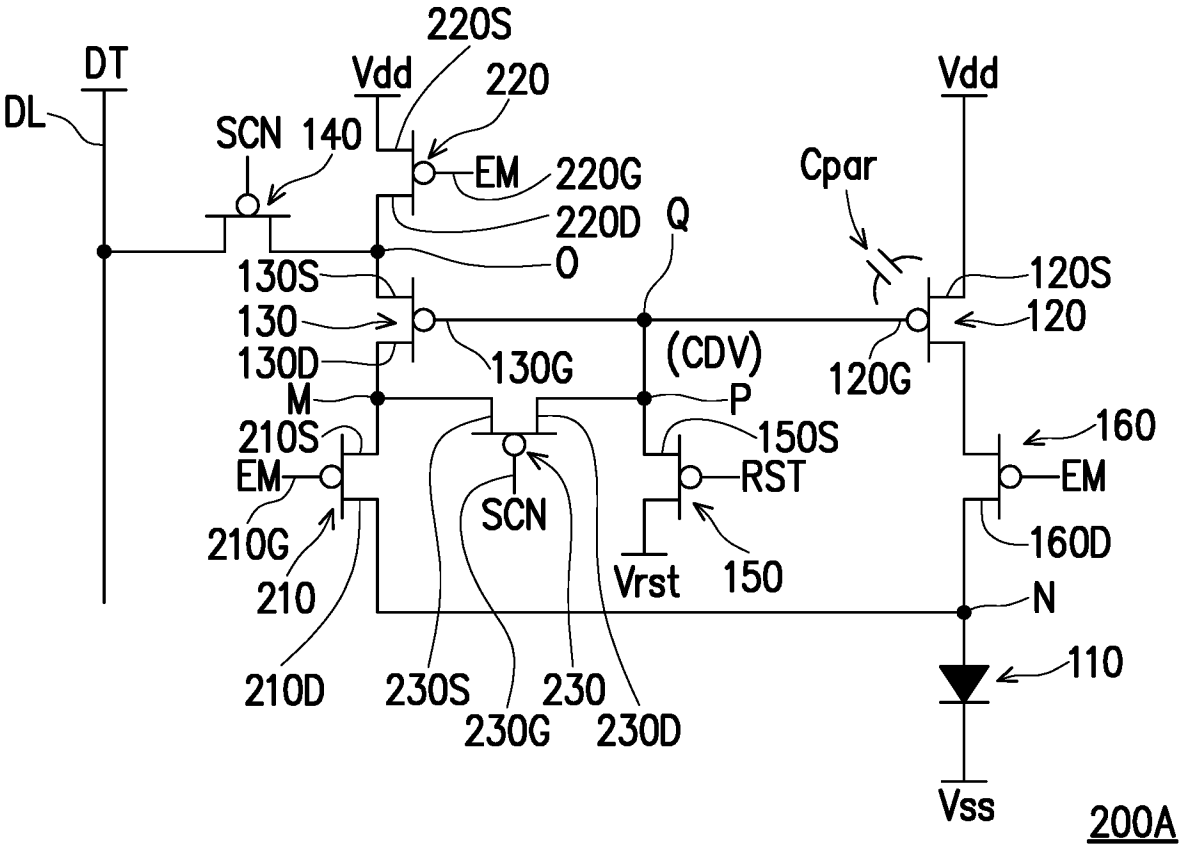
FIG. 10 schematically illustrates a driving circuit for driving a light emitting unit in accordance with some embodiments.

FIG. 10 schematically illustrates a driving circuit for driving a light emitting unit in accordance with some embodiments. In FIG. 10, a driving circuit 200A for driving a light emitting unit 110, similar to the driving circuit 100A shown in FIG. 1, includes a driving transistor 120, a compensating transistor 130, a switch transistor 140, a reset transistor 150, and a first emission transistor 160, and the difference is that the driving circuit 200A further includes a second emission transistor 210, a third emission transistor 220, and another switch transistor 230. In the embodiment, the electrical connection of the light emitting unit 110, the driving transistor 120, the compensating transistor 130, the switch transistor 140, the reset transistor 150, and the first emission transistor 160 may refer to the previous embodiments and is not reiterated. The second emission transistor 210 may include a gate terminal 210G electrically connected to an emission signal EM, a source terminal 210S electrically connected to the drain terminal 130D of the compensating transistor 130 at a node M and a drain terminal 210D electrically connected to the drain terminal 160D of the first emission transistor 160 at a node N. The third emission transistor 220 includes a gate terminal 220G electrically connected to an emission signal EM, a source terminal 220S electrically connected to a driving voltage Vdd and a drain terminal 220D electrically connected to the source terminal 130S of the compensating transistor 130 at a node O. The switch transistor 230 includes a gate terminal 230G electrically connected to a scan signal SCN, a source terminal 230S electrically connected to the drain terminal 130D of the compensating transistor 130 at the node M, and a drain terminal 230D electrically connected to the gate terminal 130G of the compensating transistor 130 through a node P and a node Q. In the embodiment, the source terminal 150S of the reset transistor 150 may be electrically connected to the drain terminal 230D of the switch transistor 230 at the node P while the node Q is electrically connected to the node P, wherein the node Q represents that the gate terminal 120G of the driving transistor 120, the gate terminal 130G of the compensating transistor 130 and the source terminal 150S of the reset transistor 150 are electrically connected. In the embodiment, the driving circuit 200A may have eight transistors, but the disclosure is not limited thereto. In some other embodiments, the driving circuit 200A may have more transistors.

The operation of the driving circuit 200A may include a reset stage, a scan stage and an emission stage. In the reset stage, similar to the previous embodiments, the reset transistor 150 is turned on while the switch transistor 140, the switch transistor 230, the first emission transistor 160, the second emission transistor 210 and the third emission transistor 220 may be turned off. Accordingly, the reset voltage Vrst may be supplied to the node P and the node Q through the turned-on reset transistor 150. The reset voltage Vrst may be stored at the gate terminal 120G of the driving transistor 120 by the parasitic capacitor Cpar between the gate terminal 120G of the driving transistor 120 and the source terminal 120S of the driving transistor 120.

In the scan stage, the reset transistor 150 is turned off, and the switch transistor 140 and the switch transistor 230 are turned on while the first emission transistor 160, the second emission 210 and the third emission transistor 220 remain off. A data voltage DT on the data line DL is allowed to be transmitted to the node O through the turned-on switch transistor 140 and the turned-on switch transistor 230 allows the node M to be electrically connected to the node P as well as the node Q, which forms a diode connection of the compensating transistor 130. The compensating transistor 130 thus allows a compensated data voltage CDV to be supplied to the node Q and the compensated data voltage CDV may be stored at the gate terminal 120G of the driving transistor 120 by the effect of the parasitic capacitor Cpar. The compensated data voltage CDV may be a result of the voltage value of the data voltage DT subtracting the absolute value of the threshold voltage of the compensating transistor 130 and enable the driving transistor 120 to be turned on. As described in the previous embodiments, the size of the driving transistor 120 is larger than that of the compensating transistor 130 while the threshold voltage of the compensating transistor 130 is the same as the threshold voltage of the driving transistor 120 substantially. The compensated data voltage CDV is desirable for the driving transistor 120 to drive the light emitting unit 110 to emit light. For example, the compensated data voltage CDV may enable the driving transistor 120 to be turned on.

In the emission stage, the first emission transistor 160, the second emission transistor 210 and the third emission transistor 220 are turned on and the switch transistor 140 and the switch transistor 230 are turned off while the reset transistor 150 remains off. The compensating transistor 130 does not involve the diode connection configuration since the switch transistor 230 is turned off in the emission stage and the compensating transistor 130 presents in a turn-on state by the compensated data voltage CDV stored on the gate terminal 130G of the compensating transistor 130. The second emission transistor 210, the second emission transistor 220 and the compensating transistor 130 are turned on to allow the driving voltage Vdd on the source terminal 220S of the second emission transistor 220 to be supplied to the node N. In addition, the first emission transistor 160 and the driving transistor 120 are turned on to allowed the driving voltage Vdd on the source terminal 120S of the driving transistor 120 to be transmitted to the node N. The node N supplied by the driving voltage Vdd is electrically connected to one terminal of the light emitting unit 110 and the other terminal of the light emitting unit 110 is electrically connected to another driving voltage Vss so that an emission current passes through the light emitting unit 110 to drive the light emitting unit 110 to emit light.

Figure 11:
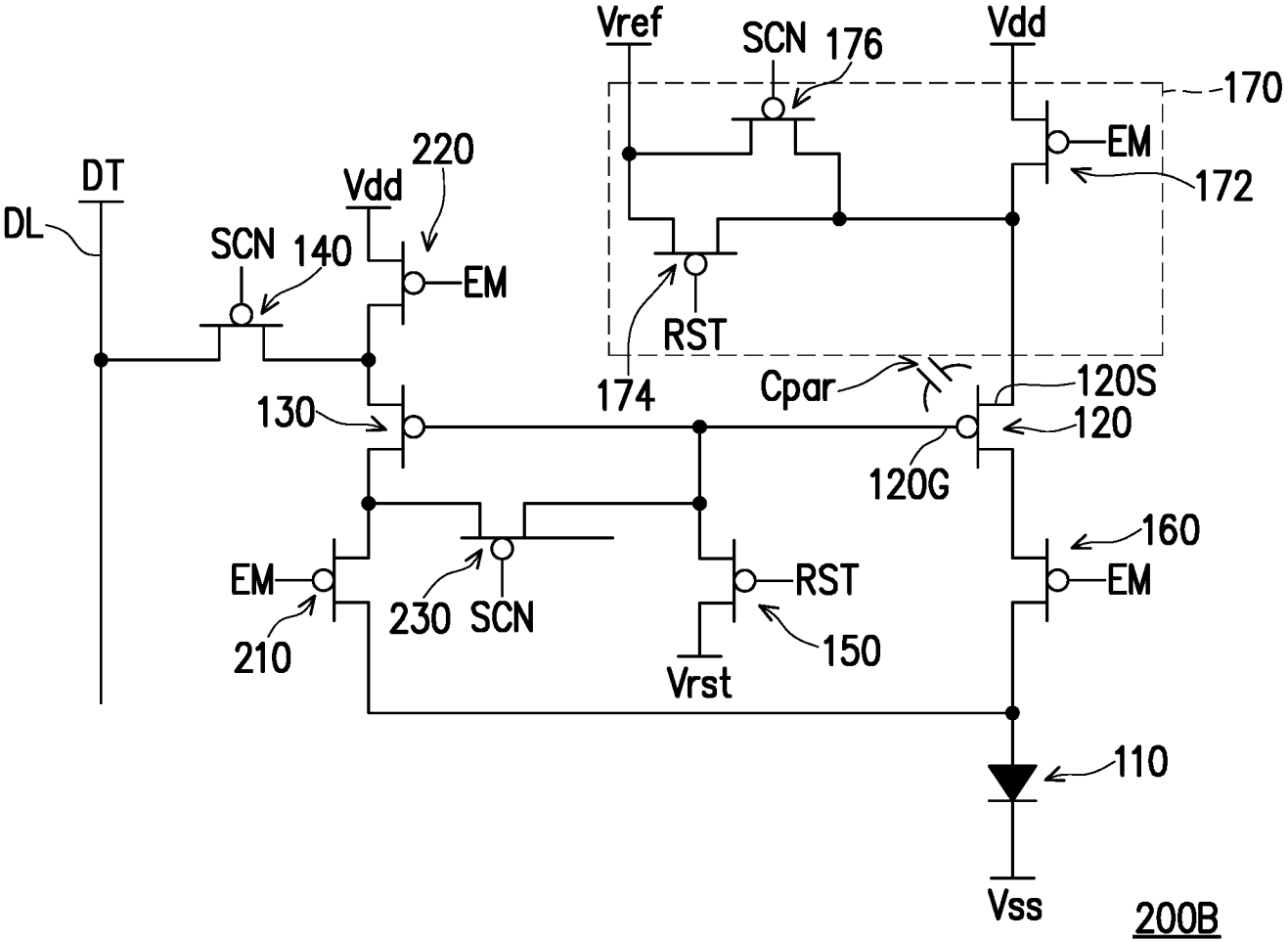
FIG. 11 schematically illustrates a driving circuit for driving a light emitting unit in accordance with some embodiments.

FIG. 11 schematically illustrates a driving circuit for driving a light emitting unit in accordance with some embodiments. In FIG. 11, a driving circuit 200B for driving a light emitting unit 110, similar to the driving circuit 200A, includes a driving transistor 120, a compensating transistor 130, a switch transistor 140, a reset transistor 150, a first emission transistor 160, a second emission transistor 210, a third emission transistor 220, and another switch transistor 230. The electrical connection of the light emitting unit 110 and the eight transistors may refer to the previous description and is not reiterated. In addition, the driving circuit 200B further includes a selection unit 170 that is substantially the same as the selection unit 170 described in FIG. 8. Specifically, the selection unit 170 may include a selection emission transistor 172, a selection reset transistor 174 and a selection switch transistor 176 to allow either the reference voltage Vref or the driving voltage Vdd is supplied to the source terminal 120S of the driving transistor 120. The electrical connection and the operation of the selection emission transistor 172, the selection reset transistor 174 and the selection switch transistor 176 may be referred to the description for FIG. 8. For example, in the reset stage the selection reset transistor 174 is turned on while the selection switch transistor 176 and the selection emission transistor 172 are turned off such that the reference voltage Vref is supplied to the source terminal 120S of the driving transistor 120. In the scan stage, the selection switch transistor 176 is turned on and the selection reset transistor 174 is turned off while the selection emission transistor 172 remains off, such that the source terminal 120S of the driving transistor 120 is still supplied by the reference voltage Vref. In the emission stage, the selection emission transistor 172 is turned on and the selection switch transistor 176 is turned off while the selection reset transistor 174 remains off, such that, the driving voltage Vdd is allowed to be supplied to the source terminal 120S of the driving transistor 120.

As described in the embodiment of FIG. 8, the reference voltage Vref and the driving voltage Vdd may be of the same voltage value substantially. The reference voltage Vref is transmitted in the reset stage and the scan stage and the light emitting unit 110 having a larger resistance compared to other components is not within the transmission path of the reference voltage Vref, a relative small current is expected for the reference voltage due to the high resistance component, or the IR drop effect on the reference voltage Vref may be minor or negligible so as to ensure the stability of the gate-source voltage of the driving transistor 120 during the emission stage.

Figure 12:
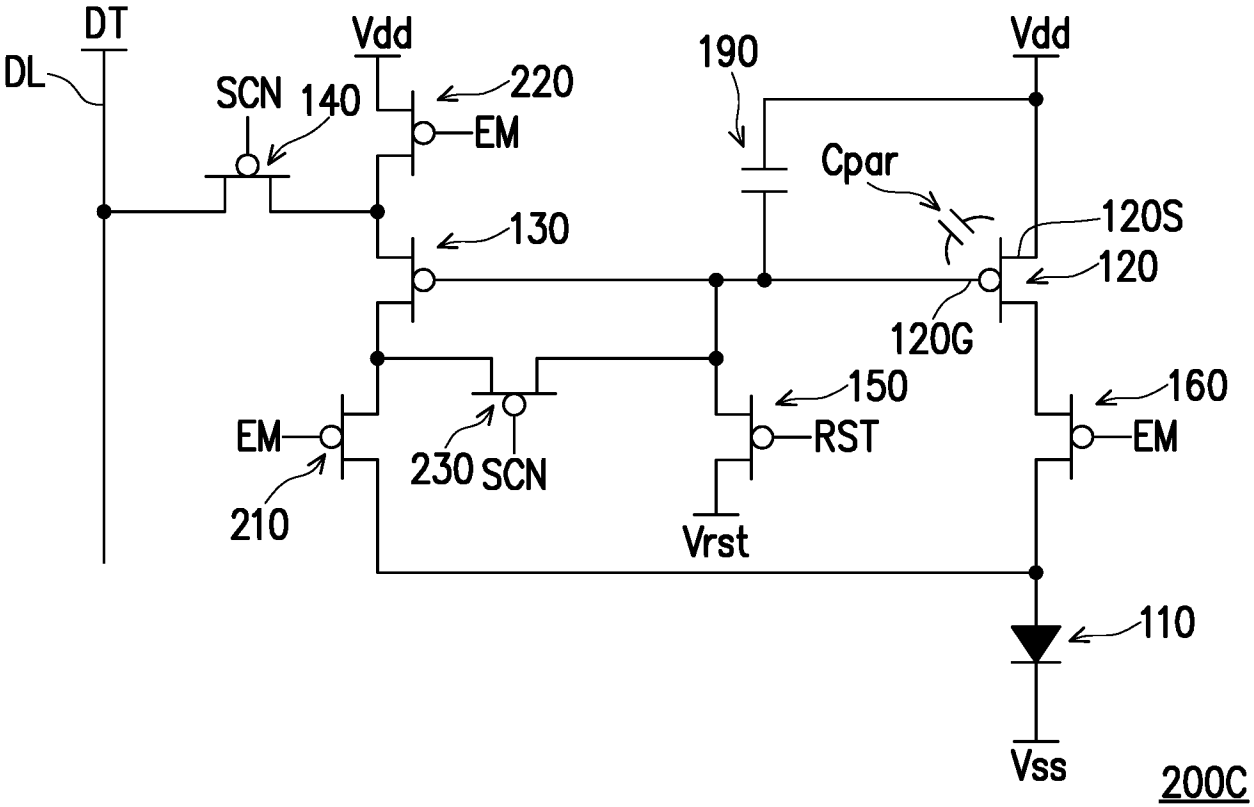
FIG. 12 schematically illustrates a driving circuit for driving a light emitting unit in accordance with some embodiments.

FIG. 12 schematically illustrates a driving circuit for driving a light emitting unit in accordance with some embodiments. In FIG. 12, a driving circuit 200C for driving a light emitting unit 110, similar to the driving circuit 200A, includes a driving transistor 120, a compensating transistor 130, a switch transistor 140, a reset transistor 150, a first emission transistor 160, a second emission transistor 210, a third emission transistor 220, and another switch transistor 230. The electrical connection of the light emitting unit 110 and the eight transistors may refer to the previous description and be not reiterated. In addition, the driving circuit 200C further includes a storage capacitor 190 that is substantially the same as the storage capacitor 190 described in FIG. 9. The storage capacitor 190 may be electrically connected between the gate terminal 120G of the driving transistor 120, and the source terminal 120S of the driving transistor 120 and provide the same effect as the parasitic capacitor Cpar between the gate terminal 120G of the driving transistor 120 and the source terminal 120S of the driving transistor 120. For example, the storage capacitor 190 and the parasitic capacitor Cpar both help to keep the gate-source voltage of the driving transistor 120.

In some embodiments, in the driving circuit 100A, the driving circuit 100B, the driving circuit 100C, the driving circuit 200A, the driving circuit 200B and the driving circuit 200C, the driving transistor 120 and the compensating transistor 130 have the same threshold voltage substantially, but the size of the driving transistor 120 is larger than the size of the compensating transistor 130, wherein the definition of the size of a transistor may refer to the description of FIGS. 5 to 7. In addition, as above mentioned, all of the transistors in the above embodiments are p-type transistors. However, the disclosure is not limited thereto.

Figure 13:
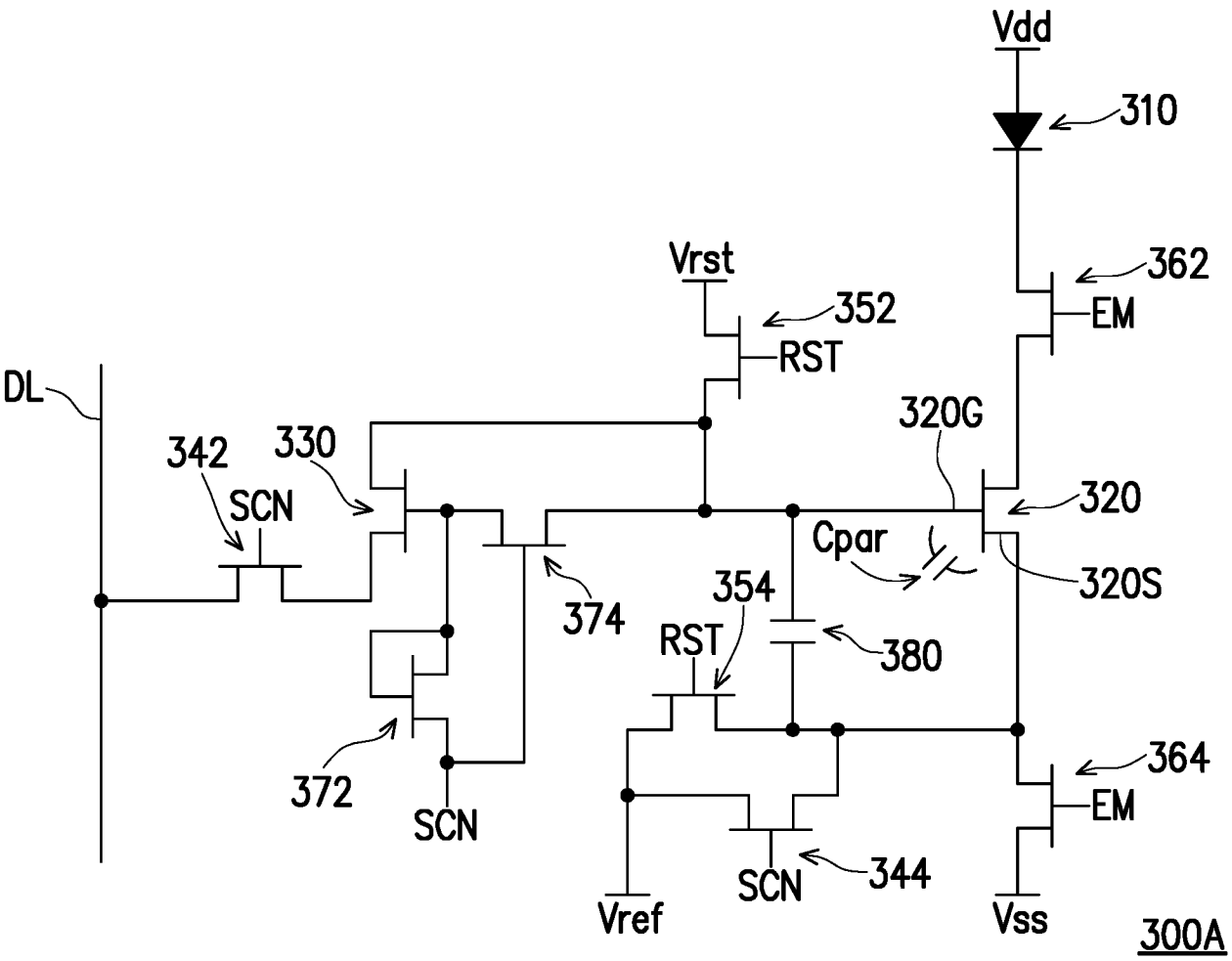
FIG. 13 schematically illustrates a driving circuit for driving a light emitting unit in accordance with some embodiments.

FIG. 13 schematically illustrates a driving circuit for driving a light emitting unit in accordance with some embodiments. A driving circuit 300A in FIG. 13 for driving a light emitting unit 310 may include a driving transistor 320, a compensating transistor 330, a first switch transistor 342, a second switch transistor 344, a first reset transistor 352, a second reset transistor 354, a first emission transistor 362, a second emission transistor 364, a first control transistor 372, a second control transistor 374 and a storage capacitor 380. Specifically, the transistors in the driving circuit 300A are all n-type transistors. Similar to the above embodiments, the driving transistor 320 is larger than the compensating transistor 330 in size and has the same threshold voltage as the compensating transistor 330 substantially. Therefore, the parasitic capacitor Cpar between the gate terminal and the source terminal of the driving transistor 320 may help to keep the gate-source voltage of the driving transistor 320.

In the embodiment, the gate terminal of the driving transistor 320 is electrically connected to the storage capacitor 380, and the driving transistor 320 is electrically connected between the first emission transistor 362 and the second emission transistor 364 while the first emission transistor 362 is electrically connected between the driving transistor 320 and the light emitting unit 310. One terminal of the light emitting unit 310 is electrically connected to a driving voltage Vdd and one terminal of the second emission transistor 364 is electrically connected to another driving voltage Vss. The first switch transistor 342 is electrically connected between a data line DL and the compensating transistor 330. The gate terminal of the compensating transistor 330 is electrically connected to the gate terminal of the driving transistor 320 through the second control transistor 374. The first control transistor 372 having a diode connection configuration is connected between the gate terminal of the compensating transistor 330 and the gate terminal of the second control transistor 374. The first reset transistor 352 is electrically connected to a reset voltage Vrst and electrically connected to the gate terminal of the driving transistor 320. The second reset transistor 354 is electrically connected to the reference voltage Vref and electrically connected to the source terminal 320S of the driving transistor 320. The second switch transistor 344 is electrically connected between the source terminal and the drain terminal of the second reset transistor 354. The storage capacitor 380 is electrically connected between the gate terminal 320G of the driving transistor 320 and the source terminal 320S of the driving transistor 320.

Figure 14:
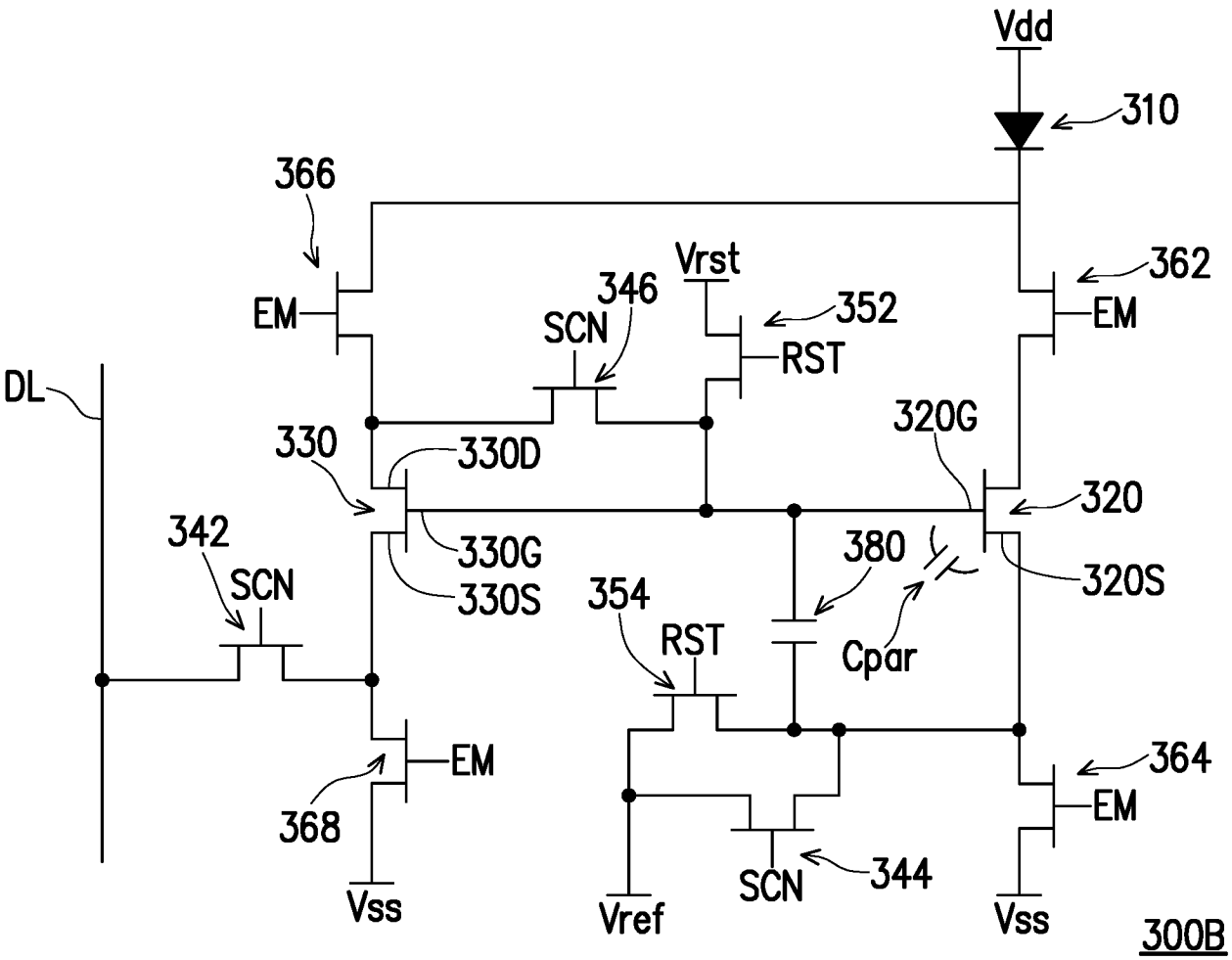
FIG. 14 schematically illustrates a driving circuit for driving a light emitting unit in accordance with some embodiments.

FIG. 14 schematically illustrates a driving circuit for driving a light emitting unit in accordance with some embodiments. A driving circuit 300B in FIG. 14 for driving a light emitting unit 310, similar to the driving circuit 300A, includes a driving transistor 320, a compensating transistor 330, a first switch transistor 342, a second switch transistor 344, a first reset transistor 352, a second reset transistor 354, a first emission transistor 362, a second emission transistor 364, and a storage capacitor 380. The driving circuit 300B may be different from the driving circuit 300A in that the driving circuit 300B does not include the first control transistor 372 and the second control transistor 374, and the driving circuit 300B further includes a third switch transistor 346, a third emission transistor 366 and a fourth emission transistor 368. Specifically, the transistors in the driving circuit 300A are all n-type transistors. The electrical connection of the light emitting unit 310, the driving transistor 320, the compensating transistor 330, the first switch transistor 342, the second switch transistor 344, the first reset transistor 352, the second reset transistor 354, the first emission transistor 362, the second emission transistor 364, and the storage capacitor 380 may refer to the description of the embodiment of FIG. 13 and be not reiterated.

In the embodiment, the third switch transistor 346 is electrically connected between the gate terminal 330G and the drain terminal 330D of the compensating transistor 330. The third emission transistor 366 is electrically connected between the light emitting unit 310 and the drain terminal 330D of the compensating transistor 330. The fourth emission transistor 368 is electrically connected to the driving voltage Vss and electrically connected to the source terminal 330S of the compensating transistor 330. The operation of the third switch transistor 346 may enable the compensating transistor 330 to have a diode connection configuration or a transistor configuration. For example, the compensating transistor 330 may serve as a driving transistor when the third switch transistor 346 is turned off.

In view of the above, the driving circuit in accordance with some embodiments of the disclosure includes a compensating transistor that has substantially the same threshold voltage as the driving transistor. The data voltage supplied to the gate terminal of the driving transistor is compensated by the compensating transistor. The compensated data voltage is stored and kept by the parasitic capacitor of the driving transistor, so that the light emitting function of the light emitting unit driven by using the driving circuit disclosed in some embodiments is desirable and stable. In other words, the driving circuit for driving a light emitting unit according to some embodiments of the disclosure may achieve improved light emitting effect.

It will be apparent to those skilled in the art that various modifications and variations can be made to the disclosed embodiments without departing from the scope or spirit of the disclosure. In view of the foregoing, it is intended that the disclosure covers combinations, modifications and variations provided that they fall within the scope of the following claims and their equivalents.

What is claimed is:

1. A driving circuit for driving a light emitting unit, the driving circuit comprising:
- a driving transistor comprising a gate terminal, a source terminal, and a drain terminal;
- a compensating transistor comprising a gate terminal electrically connected to the gate terminal of the driving transistor, a source terminal, and a drain terminal electrically connected to the gate terminal of the driving transistor;
- a switch transistor comprising a gate terminal, a source terminal, and a drain terminal electrically connected to the source terminal of the compensating transistor,
- a first emission transistor electrically connected to the drain terminal of the driving transistor;
- a second emission transistor comprising a gate terminal, a source terminal electrically connected to the drain terminal of the compensating transistor and a drain terminal electrically connected to the drain terminal of the first emission transistor; and
- a third emission transistor comprising a gate terminal, a source terminal electrically connected to a driving voltage and a drain terminal electrically connected to the source terminal of the compensating transistor.

2. The driving circuit of claim 1, wherein the driving transistor comprises a plurality of sub-transistors connected in parallel.

3. The driving circuit of claim 2, wherein the plurality of sub-transistors has a same channel size.

4. The driving circuit of claim 2, wherein the compensating transistor has a same channel size as at least one of the sub-transistors.

5. The driving circuit of claim 1, further comprising:
- a reset transistor electrically connected to the gate terminal of the driving transistor.

6. The driving circuit of claim 1, further comprising:
- a selection unit for selecting one of a driving voltage and a reference voltage to be electrically connected to the source terminal of the driving transistor.

7. The driving circuit of claim 6, wherein the selection unit comprising:
- a selection emission transistor comprising a gate terminal, a source terminal electrically connected to the driving voltage, and a drain terminal electrically connected to the source terminal of the driving transistor;
- a selection reset transistor comprising a gate terminal, a source terminal electrically connected to the reference voltage, and a drain terminal electrically connected to the drain terminal of the selection emission transistor; and
- a selection switch transistor comprising a gate terminal, a source terminal electrically connected to the reference voltage, and a drain terminal electrically connected to the drain terminal of the selection reset transistor.

8. The driving circuit of claim 7, wherein the driving voltage and the reference voltage are of the same voltage value.

9. The driving circuit of claim 1, further comprising:
- a first control transistor comprising a drain terminal electrically connected to the drain terminal of the compensating transistor, a source terminal electrically connected to the gate terminal of the compensating transistor, and a gate terminal electrically connected to the gate terminal of the switch transistor; and
- a second control transistor comprising a drain terminal electrically connected to the source terminal of the first control transistor, a source terminal electrically connected to the gate terminal of the first control transistor, and a gate terminal electrically connected to the drain terminal of the second control transistor.

10. The driving circuit of claim 9, further comprising a storage capacitor connected between the gate terminal of the driving transistor and the source terminal of the driving transistor.

11. The driving circuit of claim 1, further comprising another switch transistor comprising a gate terminal, a source terminal electrically connected to the drain terminal of the compensating transistor, and a drain terminal electrically connected to the gate terminal of the compensating transistor.

12. The driving circuit of claim 1, further comprising:
- a selection unit for selecting one of the driving voltage and a reference voltage to be electrically connected to the source terminal of the driving transistor.

13. The driving circuit of claim 12, wherein the selection unit comprising:
- a selection emission transistor comprising a gate terminal, a source terminal electrically connected to the driving voltage, and a drain terminal electrically connected to the source terminal of the driving transistor;
- a selection reset transistor comprising a gate terminal, a source terminal electrically connected to the reference voltage, and a drain terminal electrically connected to the selection node; and a selection switch transistor comprising a gate terminal, a source terminal electrically connected to the reference voltage, and a drain terminal electrically connected to the source terminal of the driving transistor.

14. The driving circuit of claim 13, wherein the driving voltage and the reference voltage are of the same voltage value.

15. The driving circuit of claim 1, further comprising a storage capacitor connected between the gate terminal of the driving transistor and the source terminal of the driving transistor.

16. The driving circuit of claim 1, wherein the driving transistor, the compensating transistor, and the switch transistor are of the same conductive type transistors.

17. The driving circuit of claim 1, further comprising a data line, wherein the source terminal of the switch transistor is electrically connected to the data line.

18. The driving circuit of claim 1, wherein the light emitting unit comprises a light emitting diode.

19. The driving circuit of claim 1, wherein a threshold voltage of the driving transistor and a threshold voltage of the compensating transistor are identical.

* * * * *